MULTI-TRACER LOGGING TECHNIQUE

BACKGROUND OF THE INVENTION

1. Field of the Invention

The present invention relates to an improved method of determining sweep and effective permeabilities of fluids flowing in an underground formation and, more particularly, to such a method which utilizes one or more gamma ray emitting tracers which are logged by the same logging tool.

2. Setting of the Invention

During a secondary or tertiary oil recovery project a displacement fluid or fluids are injected into the formation through an injection well and oil in the formation is displaced towards an offset production well. The efficiency with which the injected fluid contacts the oil bearing zones is termed "sweep efficiency". The percentage of available oil displaced by the injected fluid is termed "displacement efficiency". Both parameters, "sweep efficiency" and "displacement efficiency", are important in evaluating the displacement process and in obtaining a description of the reservoir. Various individual methods have been utilized to determine sweep efficiency of a waterflood project, and various individual methods have been utilized to determine the effective permeabilities of the swept formation. One such method used in the past involves injecting a first tracer fluid into the formation along with the injection fluid and at some later time injecting a second tracer fluid into the formation. A logging device run through an observation well would indicate the presence of the tracer fluids as they pass through the formation. However, experience has shown that many months after breakthrough of a tracer into a particular zone, a high background radiation of the first tracer may still be present. Thus, it has been extremely difficult to distinguish between the old tracer and the new, although an approximate evaluation could be made. If this evaluation was attempted with tracers injected several weeks apart, it would be virtually impossible to distinguish between the tracers at all. Thus, there is a need for a method of utilizing at least two radioactive tracers which can be distinguished.

SUMMARY OF THE INVENTION

Disclosed is a novel method of logging a plurality of underground intervals within a given formation, contemplated to overcome the foregoing disadvantages. A first radioactive tracer is introduced into the formation and the first tracer is logged as it passes through the formation. A second radioactive tracer is introduced in the same formation, and the second tracer is logged as it passes through the formation. The second tracer has a different energy level than the first level. The logs are then analyzed to determine changes in the effective permeabilities of the formations.

BRIEF DESCRIPTION OF THE DRAWING

The drawing is a sectional view of a plurality of wells penetrating a plurality of underground formations and which illustrates the advancement of tracer fluids through the formations.

DETAILED DESCRIPTION OF THE PREFERRED EMBODIMENTS

Figure 1:
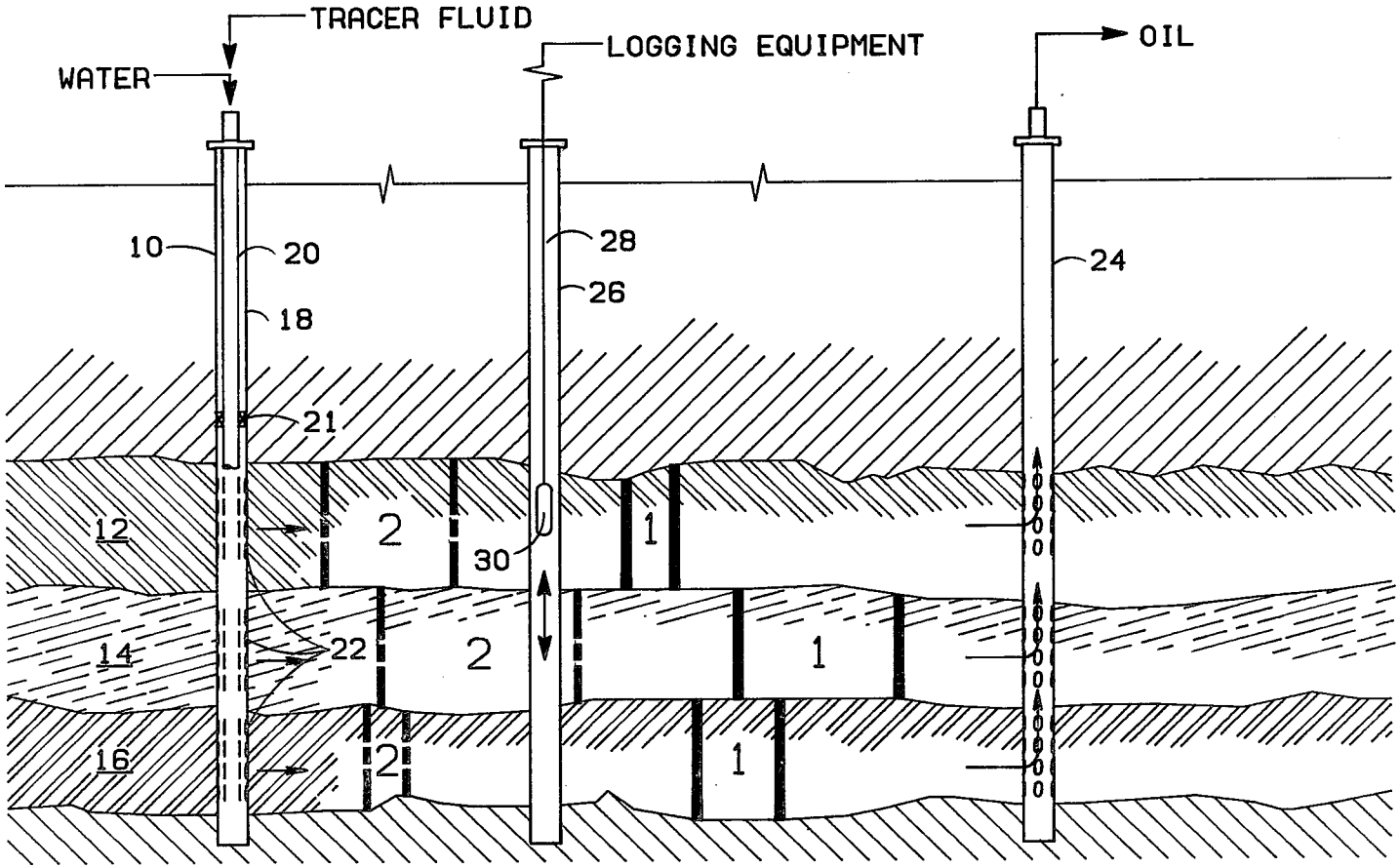

As shown in the drawing, reference character 10 indicates an injection well which penetrates a plurality of underground oil bearing intervals of a given formation or separate formations, 12, 14, and 16. The well 10 is comprised of a casing 18 and an inner tubing 20. A plurality of perforations 22 extend through the casing 18 and are spaced adjacent the formations 12, 14, and 16. The well 10 is completed in a conventional matter as is well known in the art.

The tubing 20 is set through a packer 21 above the formations of interest 12, 14, and 16, to allow any radioactive fluids to be displaced from the well 10, as will be described hereinbelow. Water is injected through the tubing 20 and into the formation 12, 14, and 16 as in a waterflood project to drive in-place oil and other hydrocarbons towards a production well 24. The produced oil from the production well 24 is collected at the surface for use elsewhere. Interposed between the injection well 10 and the production well 24 is an observation well 26. The observation well 26 is completed utilizing a nonperforated casing 28 which can be metallic or nonmetallic, such as fiber glass or plastic.

In order to determine vertical sweep and effective permeabilities of the formations 12, 14, and 16, the following procedure is utilized in accordance with the present invention. A first radioactive tracer is injected through the injection well 10 into the formations 12, 14, and 16. The tracers utilized in this invention produce gamma radiation. Such tracers which can be utilized include such water soluble tracers as cobalt 60, cobalt 58, cobalt 57, or strontium 85, iodine 131, and also a gas, such as Krypton 85. A predetermined period of time later, from several days to several weeks, a logging tool 30, capable of multi-channel analysis of gamma ray energy, such as a device marketed under the trademark "Spectralog" developed and utilized by Dresser-Atlas, is lowered into the observation well 26. Logs from the logging tool 30 obtained over a period of days record the advancement and energy levels of the tracer fluid as it passes through the formations. The waterflood project is continued and after a predetermined period of time, usually from several weeks to several months, a second radioactive tracer is then injected through the injection well 10 into the formations. The second tracer has a radioactive energy different than that from the first tracer fluid. Again a log is made utilizing the logging tool 30 through the observation well 26 as the second tracer fluid passes through the formations.

As can be seen from the drawing, the advancement of the second tracer fluid through the formation over the same given period of time is effectively greater than that of the first tracer due to the fact that the permeability of the intervals are different as the fluid saturation within the formations changes as the flood project progresses. As shown in the drawing and specifically referring to formation 14, the second tracer over the same period of time has traveled a greater distance than first tracer fluid and effectively has progressed much further than the fluids through the other formations 12 and 16.

After the second log is produced, the two logs are compared so that the effective permeabilities in the formations and the changes therein may be determined. Various methods for comparing the logs may be utilized including graphical, analytical, and digital analysis, as by utilizing a computer. From this data, a determination may be made of (1) the zones which are invaded by the injected fluid or fluids and the vertical extent to which these zones are swept; (2) the continuity of the "pay zones" between the injection, observation and produc- United States Patent [19]
Blackburn et al.
[11] Patent Number: 4,482,807
[45] Date of Patent: Nov. 13, 1984

[54] IMAGING DEVICES AND SYSTEMS

[75] Inventors: Anthony Blackburn, Southampton; John B. Readhead, Lyndhurst, both of England

[73] Assignee: U.S. Philips Corporation, New York, N.Y.

[21] Appl. No.: 355,839

[22] Filed: Mar. 8, 1982

[30] Foreign Application Priority Data

Mar. 30, 1981 [GB] United Kingdom ..... 8109819

[51] Int. Cl.[3] ..... H01J 31/49
[52] U.S. Cl. ..... 250/334; 250/370; 357/30
[58] Field of Search ..... 250/330, 332, 334, 370, 250/371; 357/30

[56] References Cited

U.S. PATENT DOCUMENTS 3,995,159 11/1976 Elliott ..... 250/334
4,377,747 3/1983 Smith et al. ..... 250/334

FOREIGN PATENT DOCUMENTS 1488258 12/1977 United Kingdom .
2019649 10/1979 United Kingdom .
2027985 2/1980 United Kingdom .
2027986 2/1980 United Kingdom .

*Primary Examiner*—Janice A. Howell
*Attorney, Agent, or Firm*—Marc D. Schechter

[57] ABSTRACT

In a thermal-radiation imaging device a detector element comprises a semiconductor strip, e.g. of n-type cadmium mercury telluride, on which biasing-electrode means are spaced for causing a bias current predominantly of majority charge carriers to flow along each strip. The bias current supports an ambipolar drift of radiation-generated charge carriers in the opposite direction. A readout area is present in a part of the drift path between a pair of spaced electrodes. At least one space extends locally across the width of strip in-between the spaced readout electrodes from at least one side of the readout area to narrow at least locally the drift path in the readout area and to increase the electric field. A detector having increased responsivity results, particularly when at least two spaces extend from opposite sides to form a meandering drift path in the read-out area. Close spacing of the readout electrodes permits good image resolution even with a long meandering drift path.

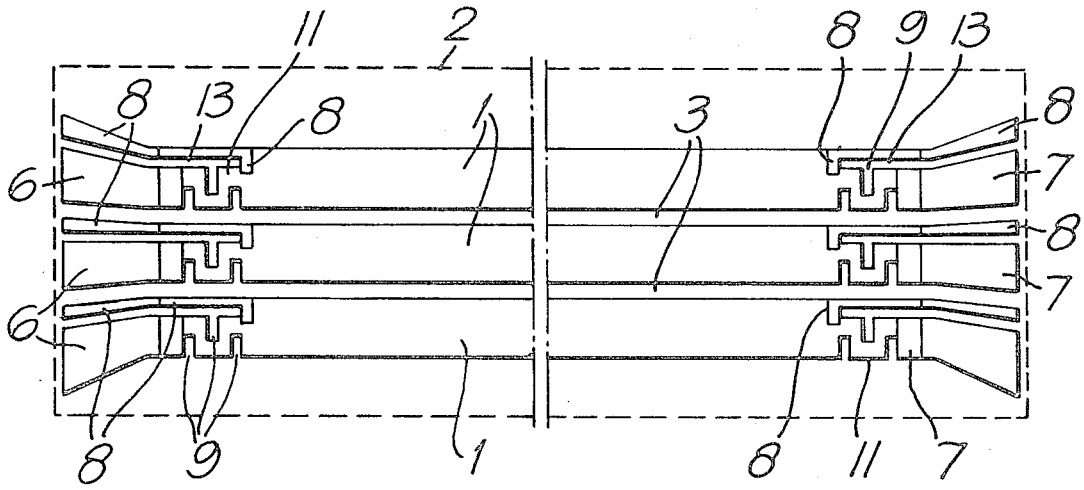

16 Claims, 7 Drawing Figures